US005465866A

United States Patent [19]

Belcastro

[11] Patent Number: 5,465,866

[45] Date of Patent: Nov. 14, 1995

[54] AUTOMATICALLY SEALING CUP

[76] Inventor: Domenic Belcastro, 32011 Distefano, Fraser, Mich. 48026

[21] Appl. No.: 273,218

[22] Filed: Jul. 11, 1994

[51] Int. Cl.[6] ..... A47G 19/22

[52] U.S. Cl. ..... 220/709; 220/714; 220/715

[58] Field of Search ..... 220/705, 707, 220/708, 709, 719, 711, 714, 715; 215/1 A

[56] References Cited

U.S. PATENT DOCUMENTS

| | | | |
|---|---|---|---|
| 2,447,870 | 8/1948 | Polcyn | 220/715 |
| 3,967,748 | 7/1976 | Albert | 220/715 |
| 4,712,704 | 12/1987 | Ramsey et al. | 220/715 |
| 5,150,815 | 9/1992 | Saklad | 220/708 |
| 5,169,016 | 12/1992 | Hinz, Jr. | 220/715 |
| 5,273,172 | 12/1993 | Rossbach et al. | 220/707 |
| 5,339,982 | 8/1994 | Tardie | 220/708 |

OTHER PUBLICATIONS

Manually Sealable Cup Product of Glenn Troudeau, Montreal Canada J4B5Y1. Date Unknown, but on sale before Jul. 11, 1994.

SIP–A–MUG Product Sold by Arbor Drugs, Inc., Troy Mich., 48084 Date Unknown, but was Advertised in a Circular on or about Jul. 1991, p. 24.

Sports Bottle Product of Countryside Products, Pickerington, Ohio. 43147 Date Unknown, but was on sale before Jul. 11, 1994.

*Primary Examiner*—Stephen J. Castellano
*Attorney, Agent, or Firm*—Peter D. Keefe

[57] ABSTRACT

An automatically sealing cup composed generally of a cup body, a lid sealingly and releasably connected with the cup body, and an automatic sealing feature that includes, generally, a flexible tube communicating with the interior space of the cup body, an aperture in the lid through which the flexible tube sealingly passes, a pivotable handle associated with the lid wherein the position of the handle determines pinching or unpinching of the tube, and, consequently, sealed and open states, respectively, of the automatically sealing cup, and a biasing member associated with the lid which automatically biases the handle to provide the sealed state. To switch the automatically sealing cup to the open state in which liquid may be extracted therefrom through the tube, a user must continuously apply pressure to the handle, upon the cessation of which the automatically sealing cup automatically reverts to the sealed state.

11 Claims, 2 Drawing Sheets

AUTOMATICALLY SEALING CUP

BACKGROUND OF THE INVENTION

1. Field of the Invention

The present invention relates to cups used for drinking, and more particularly to cups which have a lid associated therewith. Still more particularly, the present invention is related to a cup having an automatic seal feature associated with the lid which automatically seals the cup whenever the cup is not subjected to pressure applied thereto by the user.

2. Description of the Related Art

Cups are used widely for drinking liquid. Common cups have an open mouth at which a person may sip or place a straw into the cup to suckingly withdraw liquid. Problematically, an open mouth unrestrictedly permits the fluid contained in the cup to exit the cup in the event the cup is upset in some untoward manner. Thus, liquid within the cup can spill therefrom in the event the cup is dropped or dislodged from, or tipped in relation to, a resting surface, or if the cup is subjected to oscillations which generate liquid sloshing over the rim of the mouth of the cup, such as may happen when the cup is placed upon the dashboard of a moving motor vehicle.

To at least partly overcome the ease by which liquid contained in the cup may undesirably exit the cup, some cups are provided with a cap which snaps onto the rim of the cup. These types of cups are commonly found at fast food outlets for coffee, pop and other beverages. The cap has one or more discrete openings that allow a user access to the liquid only thereat. In theory, by limiting the openings of the cap, the liquid is more definitely confined to remain within the cup during such events as the liquid sloshing produced by motor vehicle movements. In practice, however, if the cup tips off the dashboard, the liquid will exit the openings in the cap as the cup crashes upon the floor, and, perhaps, the cap will pop off, thereby emptying the liquid contents of the cup even faster.

Some "sports" cups have caps that are better secured, such as by a threading engagement therebetween, and have an aperture therein through which a straw snugly passes. The straw usually has a user removable cap. Some of these cups have a manually operated pop-up vent which is sealed when pushed down and open when pushed up. These cups, while improved, still suffer from the fact that they will empty their liquid contents in the event the cup is tipped sideways, unless, fortuitously, the straw had been previously manually capped, the vent had been previously manually pushed closed, and the fit between the aperture in the lid and the straw was truly sealing.

Accordingly, what is needed is a cup which provides automatic control over sealing of the liquid within the cup.

SUMMARY OF THE INVENTION

The present invention is an automatically sealing cup which provides automatically controlled sealing of the liquid therewithin. The automatically sealing cup has two alternative states: an open state where the liquid contained therewithin is exitable therefrom and a sealed state wherein the liquid is sealed therewithin. The automatically sealing cup is inherently biased toward the sealed state. To switch the automatically sealing cup to the open state, a user must continuously apply pressure to the automatically sealing cup, upon the cessation of which the automatically sealing cup automatically reverts to the sealed state.

The automatically sealing cup according to the present invention is composed generally of a cup body, a lid sealingly and releasably connected with the cup body, and an automatic sealing feature which includes, generally, a flexible tube communicating with the interior space of the cup body, an aperture in the lid through which the flexible tube sealingly passes, a pivotable handle associated with the lid wherein the position of the handle determines pinching or unpinching of the tube, and, consequently, the sealed and open states, respectively, of the automatically sealing cup, and a biasing member associated with the lid which automatically biases the handle to a first position. At the first position the flexible tube is caused to be pinched. The handle must be pressed by a user's hand against the biasing force to a second position in order that the flexible tube becomes unpinched.

In operation, the user separates the lid from the cup body, fills the cup body with liquid, then reattaches the lid to the cup body to thereby provide an automatically sealing cup having liquid contained therein. The biasing member biases the handle to the first position whereat the flexible tube is pinched and wherein the automatically sealing cup is in the sealed state characterized by the liquid being trapped within the automatically sealing cup. When the user wishes to extract liquid from the automatically sealing cup, the user presses the handle, overcoming the biasing force of the biasing member, to the second position. At the second position, the flexible tube is no longer pinched, whereupon liquid is now passable through the flexible tube from the interior of the automatically sealing cup to a location exterior to the automatically sealing cup. The user must continuously supply the pressing force to keep the flexible tube from being automatically pinched. As soon as the user ceases to press upon the handle, the biasing force of the biasing member automatically returns the handle to the first position, wherein pinching of the flexible tube resumes and the automatically sealing cup is again in the sealed state.

Accordingly, it is an object of the present invention to provide an automatically sealing cup.

It is a further object of the present invention to provide an automatically sealing cup in which a user must continuously apply pressure thereto in order to keep the automatically sealing cup an open state for liquid withdrawal therefrom, and in which the automatically sealing cup automatically reverts to a sealed state upon cessation of the pressure.

These, and additional objects, advantages, features and benefits of the present invention will become apparent from the following specification.

DETAILED DESCRIPTION OF THE PREFERRED EMBODIMENT

Figure 1:
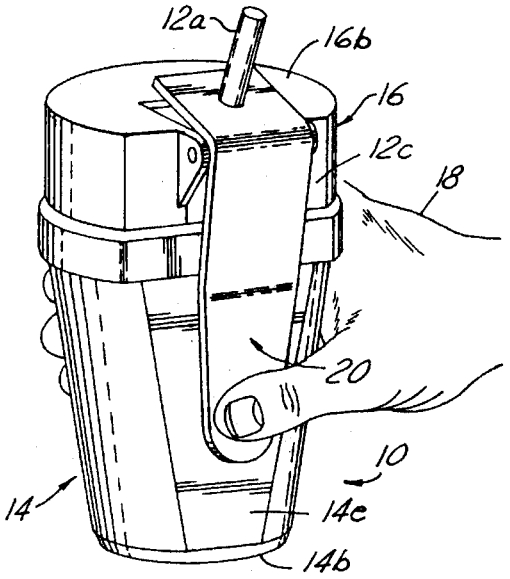
FIG. 1 is a perspective view of the automatically sealing cup according to the present invention, shown in an open state due to an application of pressure by the user.
Figure 2:
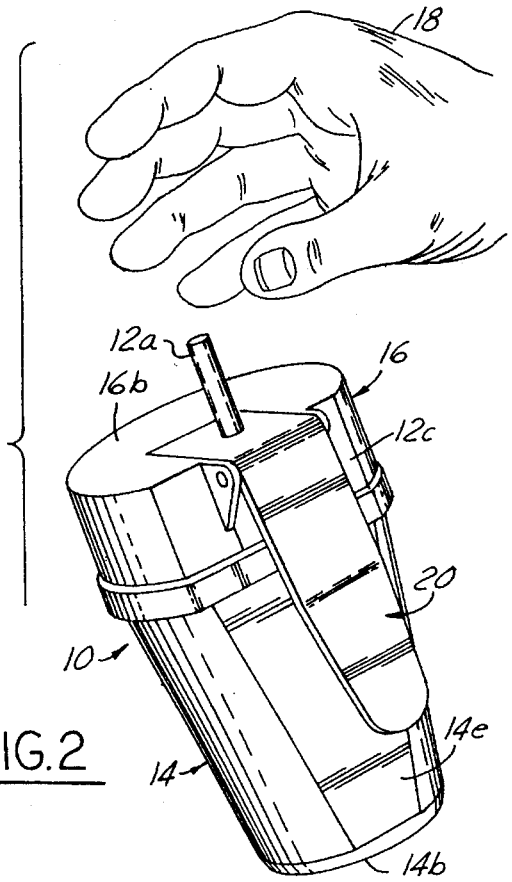
FIG. 2 is a perspective view of the automatically sealing cup according to the present invention, shown in a sealed state due to cessation of the application of pressure by the user.
Figure 3:
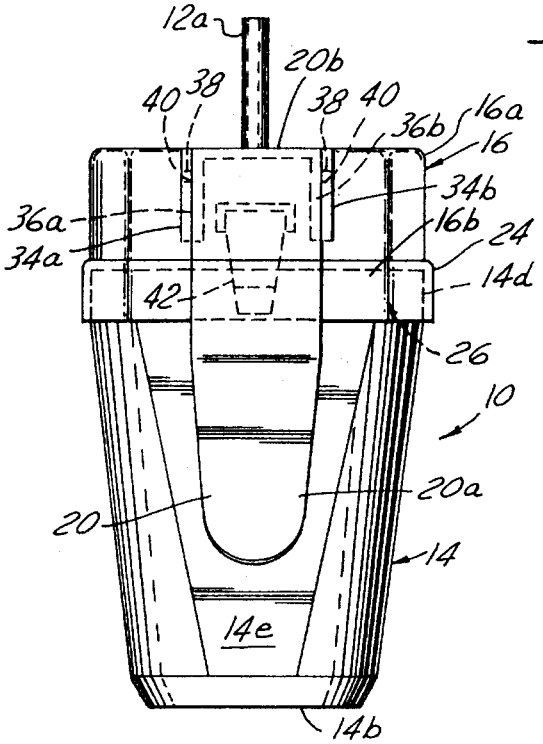
FIG. 3 is a side elevational view of the automatically sealing cup according to the present invention, shown in a sealed state.
Figure 4:
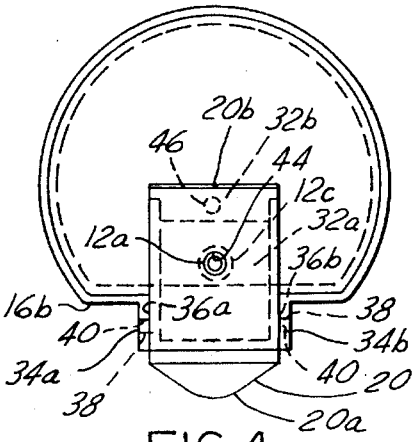
FIG. 4 is a top plan view of the automatically sealing cup according to the present invention, shown in a sealed state.

Referring now to the Drawing, FIGS. 1 and 2 generally show the automatically sealing cup 10 according to the present invention, wherein FIG. 1 shows the automatically sealing cup in an open state during which a user may extract liquid contained therein through an exterior tube section 12*a*, and wherein FIG. 2 shows the automatically sealing cup in a sealed state in which the liquid is sealed therewithin. The automatically sealing cup 10 is composed of a cup body 14 and a lid 16 which is sealingly connected with the cup body in a selectively releasable manner. Selection between the sealed and open states of the automatically sealing cup 10 is effected by a hand 18 of the user pressing a handle 20 which is pivotally mounted to the lid 16.

The structure and function of the automatically sealing cup 10 will now be detailed with greater specificity, with reference being additionally had to FIGS. 3 through 6.

Figure 5:
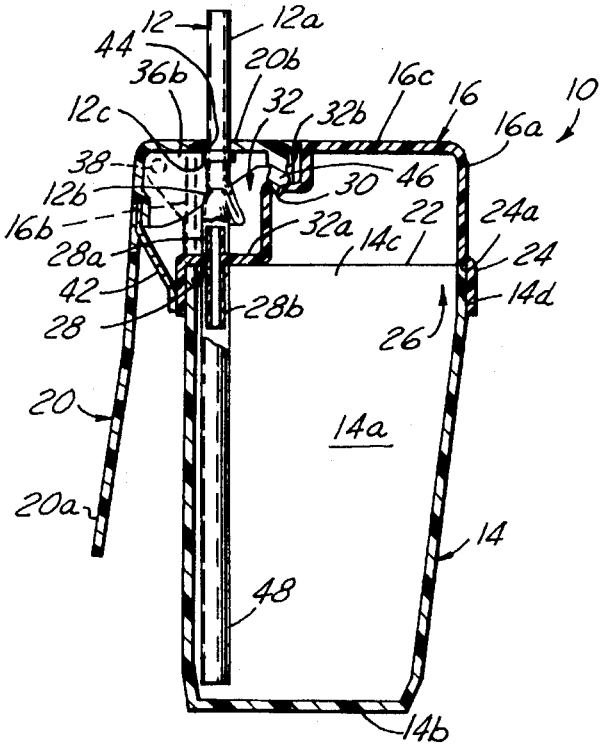
FIG. 5 is a partly sectional side view of the automatically sealing cup according to the present invention, shown in a sealed state.
Figure 6:
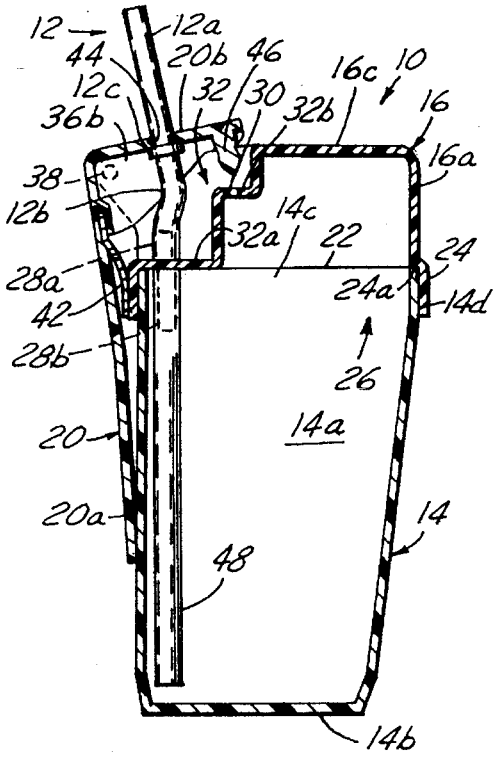
FIG. 6 is a partly sectional side view of the automatically sealing cup according to the present invention, shown in an open state.

The cup body 14 is more or less cup shaped, defining an interior space 14*a* (as shown in FIGS. 5 and 6). The cup body 14 has preferably a gently increasing taper from a flat bottom 14*b*, and terminates in an open mouth 14c defined by a rim 22. An upper body portion 14d of the cup body 14 adjacent the rim 22 is structured to provide a lid interface for fitting the cup body to the lid 16 in a selectively releasable, sealing relationship. It is preferred to include a flat body portion 14*e* in the cup body 14, to provide clearance for pivoting of the handle 20, as will become clearer from the elaboration hereinbelow. The preferred material of the cup body 14 is plastic.

The lid 16 is preferably constructed of plastic. The lid 16 is structured to sealingly interface with the upper body portion 14*d* of the cup body 14. In this regard, the lid 16 includes a lip 24 that is structured to form a seat 26 into which the upper body portion 14*d* is received with a sealing friction fit therebetween. The lip 24 preferably includes an abutment 24*a* for locatably engaging the rim 22 when the upper body portion 14*d* of the cup body 14 is fully received in the seat 26 (as best shown in FIGS. 5 and 6). Alternatively, or in addition to the aforementioned friction fit therebetween, there may be a snapping fit therebetween. In this regard further, the lid 16 is provided with a flat lid portion 16*b*, inclusive of the lip 24 so that the lip sealingly interfaces with the upper body portion 14*d* at the flat body portion 14*e* thereof. When the upper body portion 14*d* is fully received into the seat 26, the lid 16 and the cup body 14 collectively seal the interior space 14*a* everywhere except at a liquid access port 28 and at an air relief port 30, both of which being associated with the lid.

The lid 16 is provided with a barrel-shaped chamber 16*a* having a lid top 16*c*. At the flat lid portion 16*b*, the barrel-shaped chamber 16*a* has formed therein a stepped recess 32, wherein a first step 32*a* thereof is provided with the liquid access port 28 and a second step 32*b* thereof is provided with the air relief port 30. The liquid access port 28 is in the form of first and second tubular members 28*a*, 28*b* integrally formed with the first step 32*a*, and located, respectively, on either side of the first step. The air relief port 32*b* is in the form of a hole formed in the second step 32*b*. A pair of ears 34*a*, 34*b* extend outwardly from the lid 16, one ear being located on either side, respectively, of the stepped recess 32.

The handle 20 is substantially L-shaped, having an elongated first handle segment 20*a* and an integral second handle segment 20*b* oriented substantially perpendicularly to the first handle segment. At either side of the corner formed by the intersection of the first and second handle segments 20*a*, 20*b*, a web member 36*a*, 36*b*, is provided. Each web member 36*a*, 36*b*, has connected therewith, respectively, a nib 38. Each nib 38 is structured for being received, respectively, in an aperture 40 formed, respectively, in each of the ears 34*a*, 34*b*. The nibs 38 are snappingly forced into engagement with the apertures 40, whereupon the nibs are pivotal with respect to the ears 34*a*, 34*b*; accordingly, the handle 20 is pivotal with respect to the barrel-shaped chamber 16*a* and its associated stepped recess 32. In this regard, the first handle segment 20*a* is located adjacent the flat body portion 14*e* and is pivotal toward and away therefrom. A resilient biasing member 42, such as for example a Z-shaped piece of spring steel, is connected with the first handle segment 20*a* and biasably abuts the lip 24 of the lid 16. Accordingly, the biasing member 42 causes the first handle segment 20*a* to be biased away from the flat body portion 14*e* of the cup body 14 to a first handle position wherein a plug 46 located on the second handle segment 20*b* is biased toward the stepped recess 32 into sealing contact with the air relief port 30 of the second step 32*b*, as shown in FIG. 5. In this regard, the plug 46 is integrally formed with the second handle segment 20*b*, is generally cone shaped and is located so as to sealingly engage the air relief port 30 as the second handle segment tilts toward the stepped recess 32 under the biasing force of the biasing member 42. It will be noted from the Drawing that the first handle portion 20*a* is preferably provided with a small dihedral to facilitate clearance with respect to the flat body portion 14*e*.

An opening 44 is provided in the second handle segment 20*b*. When the first handle segment 20*a* is pressed by a user's hand 18 toward the flat body portion 14*e* of the cup body 14, the handle 20 will pivot at the nibs 38 thereof to a second handle position, whereupon the second handle segment 20*b* will tilt away from the stepped recess 32 and the plug 46 will separate from the air relief port 30, thereby unsealing it, as shown in FIG. 6.

A flexible tube member 12 includes the aforementioned exterior tube section 12*a*, as well as including an interior tube section 12*b*. The interior tube section 12*b* includes an annular flange 12*c*. The exterior tube section 12*a* passes through the opening 44 in the second handle segment 20*b*, wherein the annular flange 12*c* abuts the side of the second handle segment that faces toward the stepped recess 32. The interior tube section 12*b* is sealingly slipped over the first tubular member 28*a* of the liquid access port 28.

Without intervention by a user, the biasing force applied to the handle 20 by the biasing member 42 causes the handle 20 to move to the first position, shown in FIGS. 2 and 5, wherein: 1) the plug 46 of the second handle segment 20*b* seals the air relief port 30; and 2) the interior tube section 12*b* of the flexible tube 12 is pinchingly folded between the annular flange 12*b* and the first tubular member 28*a*. This pinched folding is the result of the spatial distance between the second handle segment 20*b* and the first tubular member 28*a* being less than the length of the interior tube section 12*b* between the second handle segment and the first tubular member. The pinching of the interior tube section 12*b* closes the flexible tube 12 to flow therethrough of liquid, thereby rendering the automatically sealing cup 10 to be in the sealed state, as shown in FIGS. 2 and 5. However, when a user presses the first handle segment 20*a* toward the cup body 14 to the second handle position, shown in FIGS. 1 and 6, the second handle segment 20*b* is tilted away from the stepped recess 32, whereupon the plug 46 separates from the air relief hole 30 and the interior tube section 12*b* of the flexible tube 12 straightens sufficiently that it is no longer pinched closed and liquid is now flowable therethrough. This constitutes the unsealed state of the automatically sealing cup 10, as shown in FIGS. 1 and 6.

In order to facilitate the aforementioned pinching closed of the interior tube section 12*b*, either the opening 44 and the first tubular member 28*a* can be mutually off-set to thereby encourage a predictable and reproducible folding of the interior tube section, or, as depicted in FIG. 6, some bending of the interior tube section is still present even when the second handle section 20*b* is fully tilted away from the stepped recess 32, or a combination of these.

In operation, a user separates the cup body from the lid, fills the cup body with liquid, then reseals the cup body to the lid by replacing the upper body portion into the seat. The automatically sealing cup tends naturally to be in the sealed state because of the biasing force generated by the biasing member. In order for the user to extract liquid from the automatically sealing cup, the user must press upon the first handle segment, and must continuously press thereupon to keep the automatically sealing cup in the open state. Accordingly, if for example, the automatically sealing cup slips out of the user's hands, as depicted in FIG. 2, the pressing of the first handle segment toward the cup body by the user's hand ceases. As a result, the biasing force supplied by the biasing member causes the handle to pivot such that the second handle segment tilts toward the stepped recess. Accordingly, the air relief port becomes sealed by the plug and the interior tube section of the flexible tube becomes pinched closed. Thus, the automatically sealing cup is automatically sealed before the automatically sealing cup has a chance to spill its liquid contents and long before the automatically sealing cup hits the ground.

It is to be understood from the foregoing exposition, that the separation between the first tubular member 28*a* and the second handle segment 20*b* and the length of the interior tube section 12*b* therebetween are predetermined to provide pinching closure of the interior section 12*b* of the flexible tubing 12 when the handle is at the first handle position (FIGS. 2 and 5) and to provide unpinching of the interior section 12*b* of the flexible tubing 12 when the handle is at the second handle position FIGS. 1 and 6).

It is further to be noted that for best functioning and aesthetics, the top 16*c* is located so that the second handle segment 20*b* is parallel therewith when the handle is in the first position wherein the automatically sealing cup 10 is in the sealed state, as shown in FIG. 5. In this regard, except for the stepped recess 32 and the adjacent ears 36*a*, 36*b*, the barrel-shaped chamber 16*a* is a desirable feature, but not essential.

As depicted in FIGS. 5 and 6, an optional straw 48 may be connected with the second tubular extension 28*b* as an aid to extraction of the liquid contents from the automatically sealing cup 10.

To those skilled in the art to which this invention appertains, the above described preferred embodiment may be subject to change or modification. For example, if the flat lid portion and flat body portion are each not present, and the upper body portion and lip are circular, then the sealing interface between the lid and the cup body may be by threading therebetween. Such change or modification can be carried out without departing from the scope of the invention, which is intended to be limited only by the scope of the appended claims.

What is claimed is:

1. An automatically sealing cup that is selectively unsealable by a user, comprising:

a cup body, said cup body having a mouth;

a lid;

means for releasably connecting said lid in sealing relation with respect to said cup body, said lid selectively sealing said mouth;

a liquid access port connected with said lid;

sealing means for selectively sealing said liquid access port, said mouth being sealed by said lid when said liquid access port is sealed, said sealing means comprising:

a flexible tube connected with said liquid access port; and pinching means for selectively pinching closed said flexible tube responsive to said biasing means and said control means;

biasing means for resiliently biasing said sealing means to automatically seal said liquid access port;

control means for providing user control of said sealing means responsive to continuously applied pressure thereto by the user, wherein said control means and said pinching means comprise:

a handle pivotally connected to said lid, said handle being pivotal from a first position to a second position, said handle comprising a first handle segment and a second handle segment, said second handle segment having an opening, said flexible tube passing through said opening; and stop means for providing a fixed length of said flexible tube between said second handle segment and said liquid access port;

wherein when said handle is at said first position said flexible tube is foldably pinched closed between said second handle segment and said liquid access port, and wherein when said handle is at said second position said flexible tube is unpinched between said second handle segment and said liquid access port;

wherein said biasing means biases said handle to said first position;

wherein the applied pressure is applied by the user to said first handle segment in a direction that moves said handle toward said second position; and wherein when the user ceases application of the applied pressure said biasing means automatically causes said sealing means to seal said liquid access port.

2. The automatically sealing cup of claim 1, wherein said flexible tube is foldingly pinched closed due to said fixed length exceeding a first separation length between second handle segment and said liquid access port when said handle is at said first position; and wherein said flexible tube is unpinched due to said fixed length substantially equaling a second separation length between said second handle segment and said liquid access port when said handle is at said second position.

3. The automatically sealing cup of claim 1, further comprising an air relief port connected with said lid; said sealing means further selectively sealing said air relief port when said handle is at said first position.

4. The automatically sealing cup of claim 3, wherein said first handle segment is located substantially adjacent said cup body; further wherein said second handle segment is oriented substantially perpendicular with respect to said first handle segment.

5. The automatically sealing cup of claim 4, wherein said lid comprises a stepped recess comprising a first step and a second step, said liquid relief port being located at said first step, said air relief port being located at said second step; wherein said first handle segment pivots with respect to said cup body, and wherein said second handle segment pivots with respect to said stepped recess; and wherein said sealing means further comprises a plug connected with said second handle segment, said plug sealingly engaging said air relief port when said handle is at said first position.

6. The automatically sealing cup of claim 5, wherein said flexible tube is foldably pinched closed due to said fixed length exceeding a first separation length between second handle segment and said liquid access port when said handle is at said first position; and wherein said flexible tube is unpinched due to said fixed length substantially equaling a second separation length between said second handle segment and said liquid access port when said handle is at said second position.

7. An automatically sealing cup that is selectively unsealable by a user, comprising:

a cup body, said cup body having a mouth;

a lid;

means for releasably connecting said lid in sealing relation with respect to said cup body, said lid selectively sealing said mouth;

a liquid access port connected with said lid;

an air relief port connected with said lid;

sealing means for selectively sealing said liquid access port and said air relief port, said mouth being sealed by said lid when said liquid access port and said air relief port are sealed, wherein said sealing means comprises:

a flexible tube connected with said liquid access port;

pinching means for selectively pinching closed said flexible tube responsive to said biasing means and said control means;

plug means for sealingly engaging said air relief port responsive to said biasing means and said control means;

biasing means for resiliently biasing said sealing means to automatically seal said liquid access port and said air relief port;

control means for providing user control of said sealing means responsive to continuously applied pressure thereto by the user, wherein said control means, said pinching means and said plug means comprise:

a handle pivotally connected to said lid, said handle being pivotal from a first position to a second position, said handle comprising a first handle segment and a second handle segment, said second handle segment having an opening, said flexible tube passing through said opening;

stop means for providing a fixed length of said flexible tube between said second handle segment and said liquid access port; and a plug connected with said second handle segment, said plug sealingly engaging said air relief port when said handle is at said first position;

wherein when said handle is at said first position said flexible tube is foldingly pinched closed between said second handle segment and said liquid access port, and wherein when said handle is at said second position said flexible tube is unpinched between said second handle segment and said liquid access port;

wherein said biasing means biases said handle to said first position;

wherein the applied pressure is applied by the user to said first handle segment in a direction that moves said handle toward said second position; and wherein when the user ceases application of the applied pressure said biasing means automatically causes said sealing means to seal said liquid access port and said air relief port.

8. The automatically sealing cup of claim 3, wherein said flexible tube is foldingly pinched closed due to said fixed length exceeding a first separation length between second handle segment and said liquid access port when said handle is at said first position; and wherein said flexible tube is unpinched due to said fixed length substantially equaling a second separation length between said second handle segment and said liquid access port when said handle is at said second position.

9. The automatically sealing cup of claim 7, wherein said first handle segment is located substantially adjacent said cup body; further wherein said second handle segment is oriented substantially perpendicular with respect to said first handle segment.

10. The automatically sealing cup of claim 9, wherein said lid comprises a stepped recess comprising a first step and a second step, said liquid relief port being located at said first step, said air relief port being located at said second step; wherein said first handle segment pivots with respect to said cup body, and wherein said second handle segment pivots with respect to said stepped recess.

11. The automatically sealing cup of claim 10, wherein said flexible tube is foldingly pinched closed due to said fixed length exceeding a first separation length between second handle segment and said liquid access port when said handle is at said first position; and wherein said flexible tube is unpinched due to said fixed length substantially equaling a second separation length between said second handle segment and said liquid access port when said handle is at said second position.

* * * * *

UNITED STATES PATENT AND TRADEMARK OFFICE

CERTIFICATE OF CORRECTION

PATENT NO. : 5,465,866

DATED : November 14, 1995

INVENTOR(S) : Domenic Belcastro

It is certified that error appears in the above-identified patent and that said Letters Patent is hereby corrected as shown below:

Column 8,

At Claim 8, line 1 thereof, after "claim" delete "3" and insert therefor

—7—.

Signed and Sealed this

Fourteenth Day of January, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,465,866
DATED : November 14, 1995
INVENTOR(S) : Domenic Belcastro It is certified that error appears in the above-identified patent and that said Letters Patent is hereby corrected as shown below:

In Claim 1, at Column 6, line 14, after "to" delete "said" and insert therefor --a--.

In Claim 1, at Column 6, beginning of line 15, delete "said" and insert therefor --a--.

In Claim 1, at Column 6, beginning of line 16, insert –said--.

In Claim 1, at Column 6, beginning of line 18, insert –said--.

In Claim 5, Column 6, last line thereof (line 65), after "liquid" delete "relief" and insert therefor --access--.

In Claim 7, at Column 7, line 32, after "to" delete "said" and insert therefor --a--.

In Claim 7, at Column 7, beginning of line 33, delete "said" and insert therefor --a--.

In Claim 7, at Column 7, beginning of line 376, insert –said--.

In Claim 7, at Column 7, beginning of line 40, insert –said--.

In Claim 10, Column 8, line 38, after "liquid" delete "relief" and insert therefor --access--.

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*